US005934939A

United States Patent [19]

Thenaisie et al.

[11] Patent Number: 5,934,939

[45] Date of Patent: Aug. 10, 1999

[54] SHIELDED CONNECTOR, NOTABLY OF THE TYPE COMPRISING A PLUG AND A SOCKET DESIGNED TO BE ATTACHED TO A FLAT SUPPORT

[75] Inventors: Jacky Thenaisie, Le Mans; Patrick Champion, Change, both of France

[73] Assignee: Framatome Connectors International, Courbevoie, France

[21] Appl. No.: 08/843,015

[22] Filed: Apr. 11, 1997

[30] Foreign Application Priority Data

Apr. 12, 1996 [FR] France ..... 96 04595

[51] Int. Cl.[6] ..... H01R 13/648

[52] U.S. Cl. ..... 439/607; 439/108

[58] Field of Search ..... 439/607, 609, 439/610, 108

[56] References Cited

U.S. PATENT DOCUMENTS

| | | | |
|---|---|---|---|
| 5,030,140 | 7/1991 | Sugiyama | 439/607 |
| 5,259,773 | 11/1993 | Champion et al. | 439/108 |
| 5,277,624 | 1/1994 | Champion et al. | 439/607 |
| 5,356,301 | 10/1994 | Champion et al. | 439/108 |
| 5,429,520 | 7/1995 | Morlion et al. | 439/608 |
| 5,500,788 | 3/1996 | Longueville et al. | 439/108 |
| 5,509,823 | 4/1996 | Harting et al. | 439/607 |
| 5,511,992 | 4/1996 | Thalhammer | 439/609 |
| 5,522,731 | 6/1996 | Clark et al. | 439/608 |
| 5,564,948 | 10/1996 | Harting et al. | 439/607 |
| 5,879,193 | 3/1999 | Thenaisie et al. | 439/607 |
| 5,879,194 | 3/1999 | Thenaisie et al. | 439/607 |

FOREIGN PATENT DOCUMENTS

| | | |
|---|---|---|
| 0627789 A1 | 12/1994 | European Pat. Off. . |
| 0649195 A1 | 4/1995 | European Pat. Off. . |
| WO 94/10724 | 5/1994 | WIPO . |

*Primary Examiner*—Paula Bradley
*Assistant Examiner*—Tho Dac Ta
*Attorney, Agent, or Firm*—Perman & Green, LLP

[57] ABSTRACT

The invention concerns a connector of the shielded type comprising a socket (1) attached to a printed circuit board (CI) and a plug (7) designed to be mechanically and electrically coupled to socket (1). A first shielding component (2, 4) is extended by elastic locking projections (22) provided with hooks (24). Shielding (9*a*) of plug (7) comprises openings (90*a*) in which these hooks (24) engage. These projections (22) rub against shielding (9*a*) of plug (7) and establish a galvanic contact between shieldings (9*a*, 2, 4) of plug (7) and socket (1). They also assure a locking of the latter in the socket (1).

7 Claims, 4 Drawing Sheets

SHIELDED CONNECTOR, NOTABLY OF THE TYPE COMPRISING A PLUG AND A SOCKET DESIGNED TO BE ATTACHED TO A FLAT SUPPORT

BACKGROUND OF THE INVENTION

1. Field of the Invention

The present invention concerns a shielded connector, and more precisely a shielded connector of the type comprising a plug and a socket designed to be attached to a flat support, notably a printed circuit board.

Numerous connections are known, designed to be attached by soldering to a printed circuit board provided with metallized holes.

The Applicant proposed in European Patent Application EP-A-0 649,195 a connection element having an insulating bridge piece with a "U" shaped section and elbow contact elements emerging inside the "U" structure on one end. The other end is inserted by force ("press fit") into the metallized holes of a printed circuit board. Moreover, according to one interesting characteristic, it has a rear insulating component surrounding the electrical contact elements in their bent part and a holding piece also inserted into the printed circuit board.

This connection element forms a socket designed to receive a plug of complementary shape. The arrangements used advantageously protect the bridge piece during vacuum soldering operations of the connection element and other components of the card.

For certain applications, it is necessary to have a connector that is insensitive to electromagnetic interference, notably when the signals carried are signals called "weak" and at high or very high frequency. To do this, the connector elements must be provided with a shielding. Moreover, a good ground continuity must be made between the two elements (plug and socket), on the one hand, and between the socket and the printed circuit card, on the other hand.

2. Prior Art

Shielded connection elements have been proposed, for example in the patents U.S. Pat. No. 5,277,624 (Patrick CHAMPION et al.), U.S. Pat. No. 5,259,773 (Patrick CHAMPION et al.) or U.S. Pat. No. 5,356,301 (Patrick CHAMPION et al.). These modular connection elements permit creating electrical contacts from a mother card and/or a daughter card.

In order to create ground continuity, two elastic metallic projections in the form of a cross are provided, of one piece with the socket and cooperating with openings pierced in the walls facing the socket, so as to come into galvanic contact with the shielding of the corresponding plug. Although this pair of projections exerts a pressure force on the plug, the holding of the plug inside the socket is especially accomplished by inserting the male contact elements of one of the components (for example, the socket) into the female contacts of the other component (for example, the plug). In other words, a true locking is not provided, and the quality of the ground continuity can fluctuate.

The invention therefore has the primary goal of a good ground continuity between the socket and the plug.

In one preferred variant, it also has the goal of assuring an effective locking between the socket and the plug.

The invention also seeks to simultaneously fulfill two functions, without having recourse to complex means.

This preferred variant of embodiment also retains, with regard to the socket, the essentials of the advantageous structure of the connection element according to the above-mentioned European Patent Application EP-A-0 649,195 mentioned above.

In order to achieve its goal, the invention notably provides a shielding element forming a spring and extending the principal shielding of the socket. This shielding element assures a good ground continuity by applying essentially its entire width onto the plug shielding.

In the preferred variant, the shielding element has a hook cooperating with an opening provided in one wall of the plug to assure the locking function.

The assembly does not perceptibly increase the complexity of manufacturing operations, nor the manufacturing costs.

SUMMARY OF THE INVENTION

The invention therefore has for a subject a shielded connector comprising a socket and a plug designed to be coupled by insertion of the plug into the socket, the plug being covered by a shielding of electrically conductive material on at least one of its walls, characterized in that at least one first wall of the socket, corresponding to that of the plug, is covered by a shielding of electrically conductive material, in that this shielding is extended toward the front by a strip made up of at least one projection forming a spring, so as to press on the plug shielding during insertion of the latter and permit a galvanic contact between the shieldings of the plug and the socket.

BRIEF DESCRIPTION OF THE DRAWINGS

The invention will be better understood and other characteristics and advantages will appear upon reading the description that follows in reference to the attached figures, and among which.

DETAILED DESCRIPTION

In order to better understand these concepts without limiting in any way the scope of the invention, we will describe below one preferred example of embodiment of the connector according to the invention, i.e., a connector comprising a socket whose structure roughly conforms to that described in European Patent Application EP-A-0 649,195 mentioned above. Also in the following, only the elements indispensable to a good comprehension of the invention will be specified. For a more detailed description of the socket, it would be helpful to refer to this European Patent Application.

Figure 1:
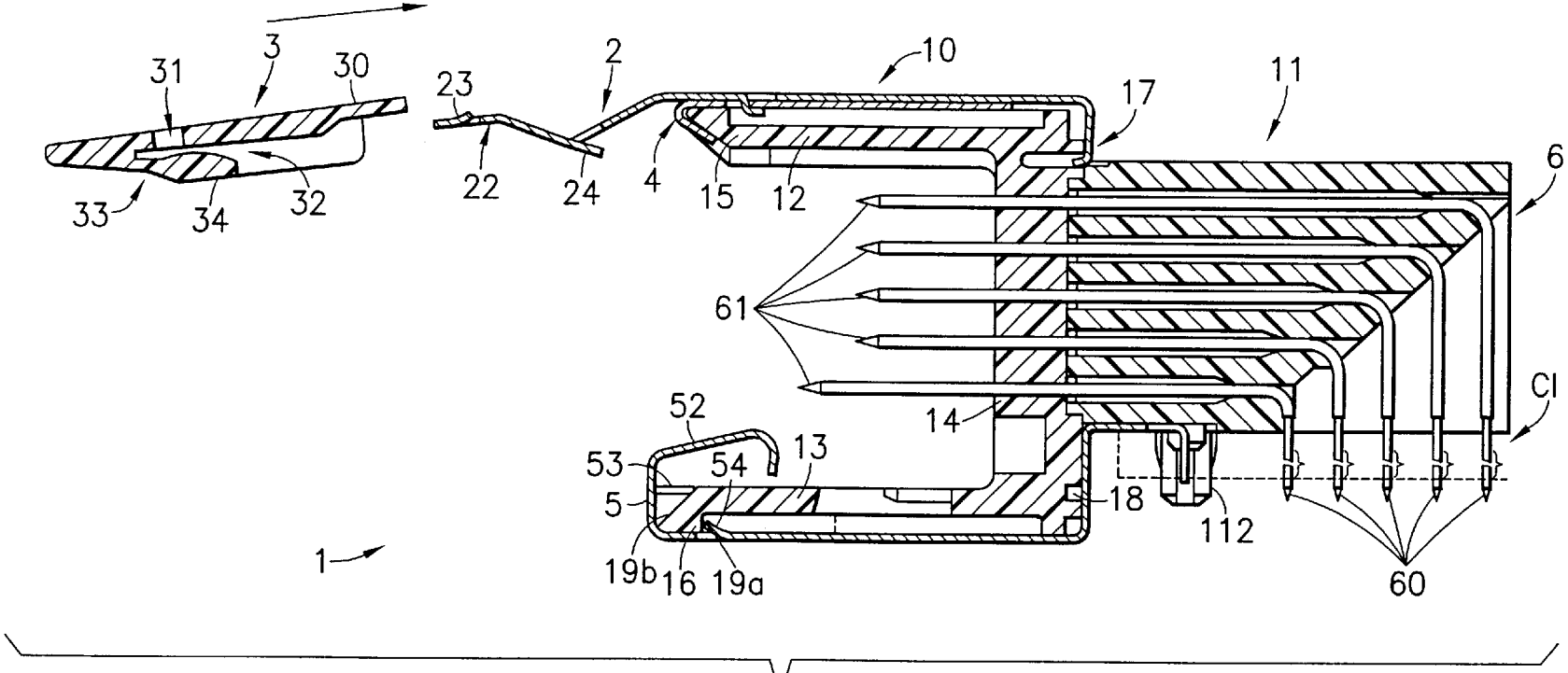
FIG. 1 is a cross-sectional elevation view of one preferred mode of embodiment for a connector socket according to the invention.

FIG. 1 illustrates such a socket 1, in longitudinal section. Other than the arrangements specific to the invention, which will be explained below, it essentially comprises three parts:

a front insulating bridge piece 10, of "U" shaped section, a rear insulator 11, and a set of electrical contact elements 6 bent at a 90° angle. Front bridge piece 10 has two lateral arms 12 and 13, and a central region 14 pierced by electrical contact elements 6. In the example illustrated, they are male elements. The number of electrical contact elements 6 and their arrangement depend on the specific application. They are generally organized in a matrix formation: lines and columns. Front parts 61 (linear) emerge between arms 12 and 13, and are designed to be inserted into female contacts carried by a plug (not shown in FIG. 1).

Arms 12 and 13 form on the front face a mouth comprising flared lips (chamfers) 15 and 16.

Rear insulating component 11 covers the rear of electrical contact elements 6, at least over the zone comprised between central region 14 of bridge piece 10 and the elbow of these electrical contact elements. Ends 60 of the vertical parts of the latter are inserted by force ("press fit") into metallized holes of a printed circuit board CI, and soldered in the usual way.

Rear insulating component 11 is advantageously provided with a holding piece 112 also pressed into printed circuit board CI.

According to a primary characteristic of the invention, the socket is provided with at least one shielding component and preferentially two: 2, 4 and 5, arranged on the upper and lower surfaces, respectively, of upper and lower arms 12 and 13 of socket 1. These are metal plates with a small thickness, but nevertheless sufficient to retain a spring effect. For example, for sockets contained in a cube of approximately 30 mm per side, the typical thickness is 0.3 mm.

Figure 5:
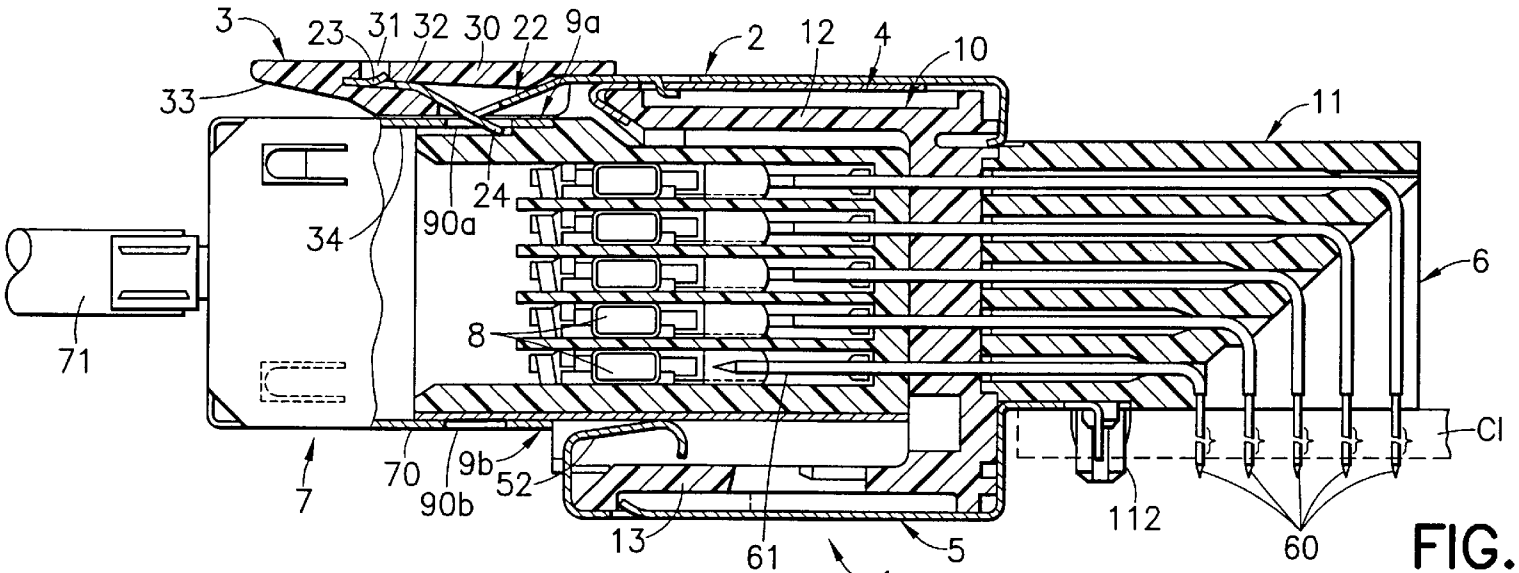
FIG. 5 illustrates, in section, a connector according to the invention for which the plug is locked in the socket.
Figure 6:
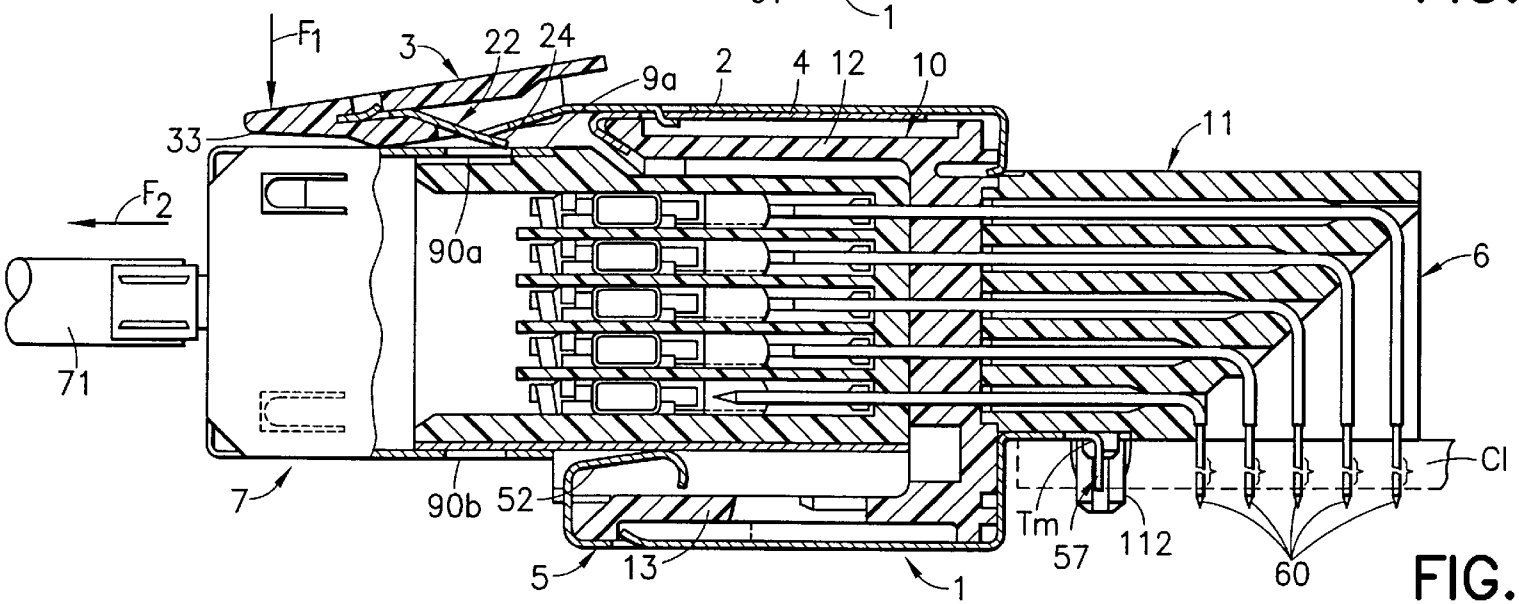
FIG. 6 illustrates, in section, the unlocking of the plug from the socket.

In addition to the primary function of shielding socket 1, this system also permits a good ground continuity with the shielding of a plug 7 inserted into socket 1, as will be shown in regard to FIG. 5. Finally, in the preferred variant, it permits locking of this same plug 7 inside socket 1.

Figure 2A:
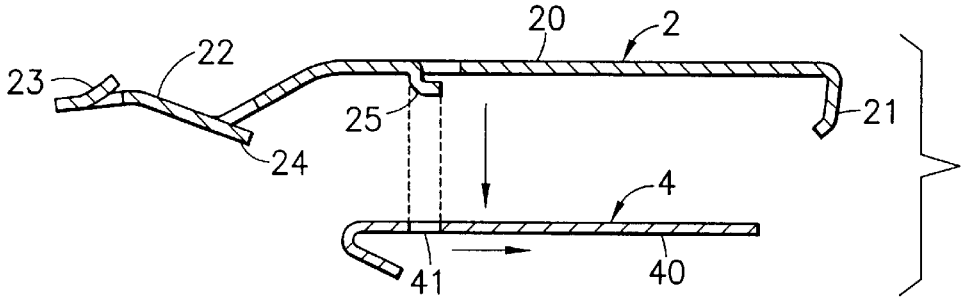
FIGS. 2*a*–2*c* are detail figures illustrating the shielding element forming a spring joined to the socket according to FIG. 1.
Figure 2B:
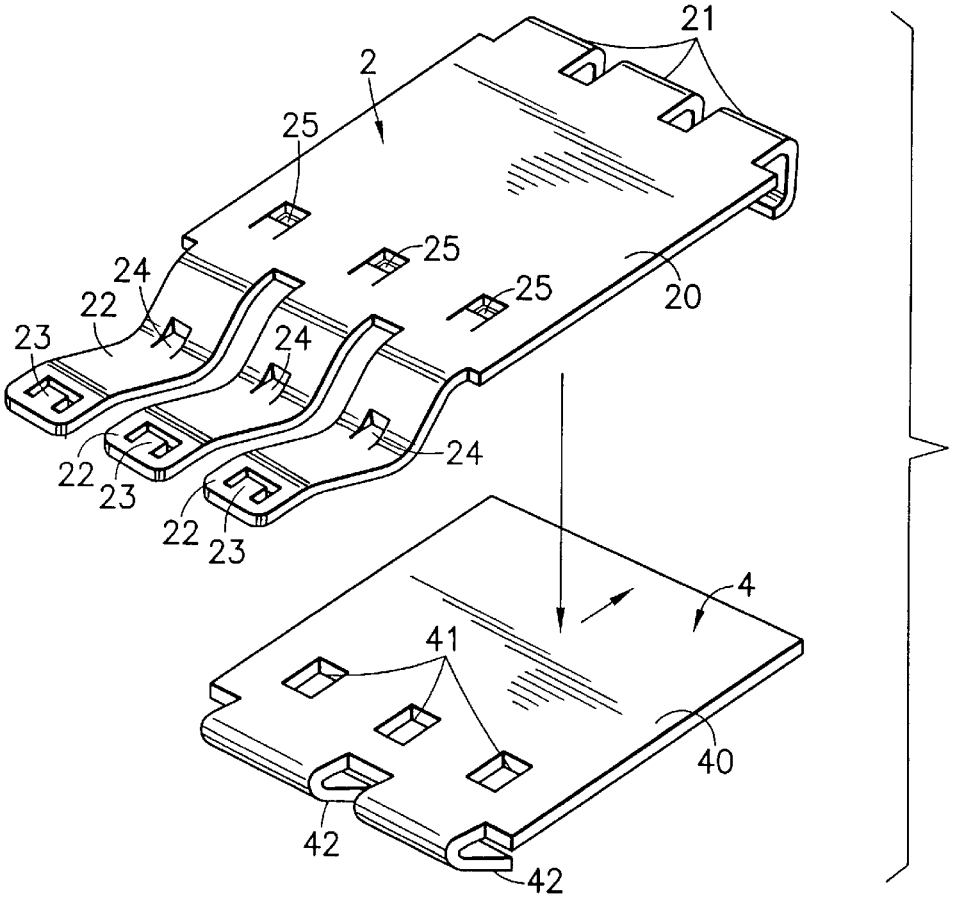
Figure 2C:
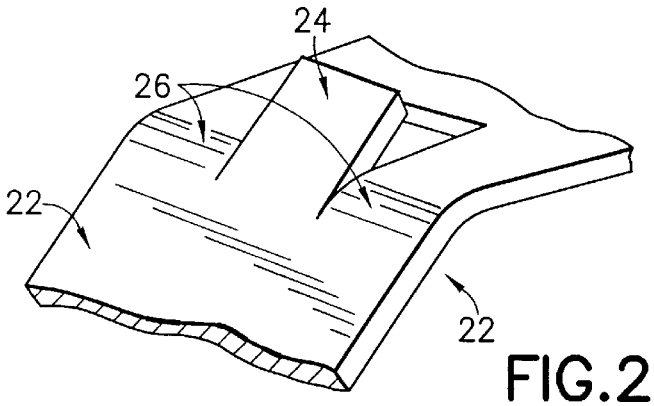

The upper shielding component has two plates 2 and 4. It is illustrated in a more detailed manner by FIGS. 2*a* and 2*b*. FIG. 2*a* illustrates, in section, the two plates 2 and 4, making up the upper component. FIG. 2*b* illustrates, these two plates, in exploded view, before assembly and FIG. 2*c* illustrates a bottom detail of plate 2, after 180° rotation Plate 2, or locking bar, is made up of a principal body 20, extended on the front surface by tabs 22 forming a spring (three in the example described), whose form is roughly that of a flared "V". This principal body 20 is extended on the rear by bent projections 21 (three in the example described) designed to be hooked onto the back of bridge piece 10. To do this, an appropriate slot or openings 17 are provided on central region 14.

Plate 4 comprises a principal body 40 covering the upper surface of upper arm 12 and extended on the front by bent projections 42 (two in the example described) designed to be hooked onto the front of bridge piece 10, more specifically on upper flared lip 15.

However, before joining these two plates 2 and 4 with bridge piece 10, they are assembled. To do this, a row of openings 41 (three in the example described) are provided in principal body 40 of plate 4 and projections 25 are cut in principal body 20 of plate 2. As shown in FIG. 2*b*, the two plates 2 and 4 are brought together and joined to one another (vertical arrow), projections 25 being introduced into openings 41. Then, by a relative translation movement (horizontal arrow), the two plates are joined by engaging projections 25 in openings 41.

Figure 4:
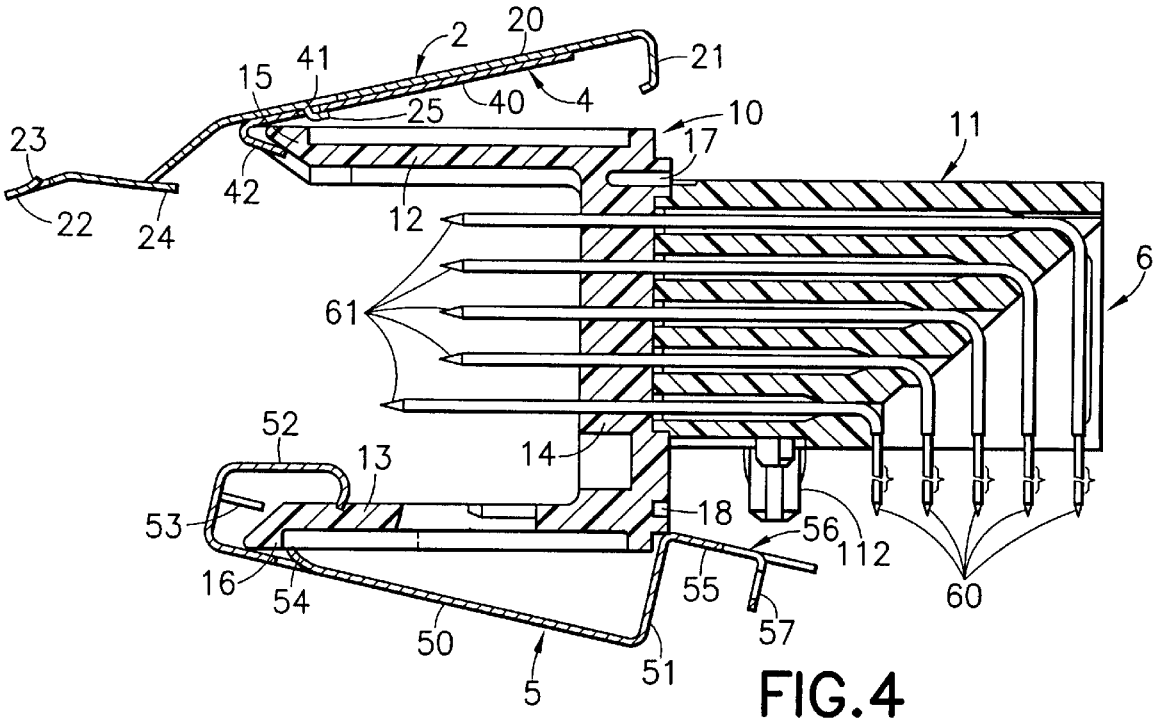
FIG. 4 illustrates the phases of mounting the shielding components of a socket according to the invention.

It is sufficient to ratchet this assembly, plates 2 and 4, into the socket as shown in FIG. 4. Bent projections 42 are hooked onto lip 15 and, by spring effect, bent projections 21 are ratcheted into the slot or openings 17.

Figure 3A:
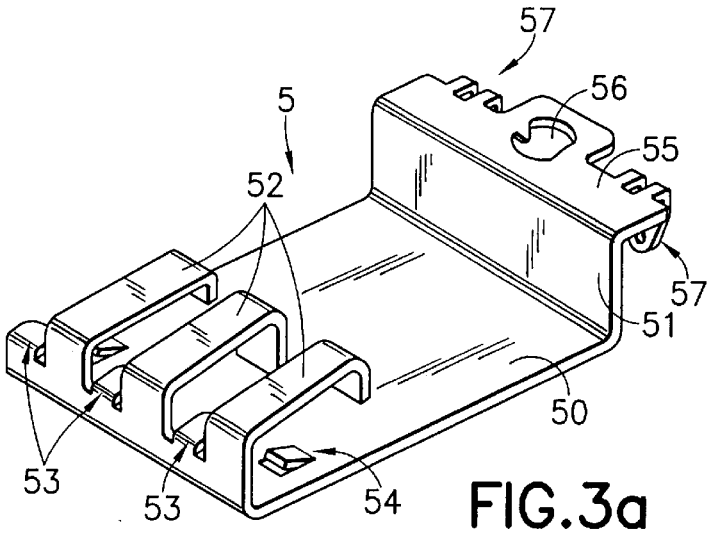
FIGS. 3*a*–3*c* illustrate the phase of mounting the shielding onto the socket of FIG. 1.
Figure 3B:
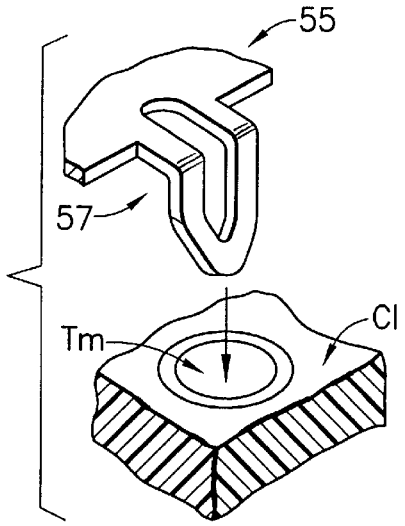
Figure 3C:
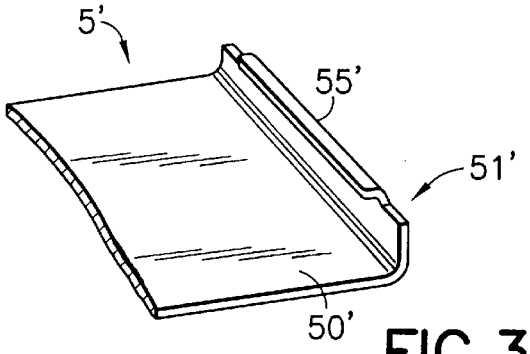

Lower shielding component 5 is illustrated more particularly by FIGS. 3*a* to 3*c*.

It comprises a principal body 50 roughly covering the lower surface of lower arm 13 of bridge piece 10. This principal body 50 is extended, toward the front, by projections or sliding contacts 52 bent back on themselves, so as to make a spring. Alternating with these projections, hooks 53 are provided, also made up by projections bent back on themselves, but of lower height. Finally, a set of projections or hooks 54 is also provided, cut on the front part of principal body 50, but behind projections 53.

These hooks 54 cooperate with projections 53 so that plate 5 can be hooked onto lower lip 16 of bridge piece 10, as is shown more particularly in FIG. 4. This latter has sharp rear wall 19*a* so that it is imprisoned between projections 53 which slide on front wall 19*b* of inclined slope, and hook 54, which is ratcheted onto rear surface 19*a* (see FIG. 1). Bent projections 52, forming a spring, re-enter inside bridge piece 10.

In a first variant illustrated by FIG. 3*a*, the principal body is extended by a vertical wall 51, bent in order to form a horizontal plate 55. This latter has an opening 56 designed to receive holding piece 112, before inserting the latter into printed circuit CI. According to this variant, plate 5 is joined to socket 1, on the one hand, by the set of front projections 53 and 54, and on the other hand, by holding piece 112, as is shown in FIG. 4.

Advantageously, additional bent tabs 57 are provided on the rear of horizontal plate 55. These latter, as shown in FIG. 3*b*, are inserted by force [press fit] into metallized holes Tm, made in the printed circuit board CI. This variant permits a good ground recovery on the printed circuit.

In a second variant, illustrated by FIG. 3*c*, lower plate 5' still has a principal body 50', which is terminated by a vertical wall 51', but the horizontal plate is replaced by a bend 55' toward the inside designed to be inserted into a slot 18 provided on the rear of central region 14 of bridge piece 10.

According to the most important characteristic of the invention, the shielding components play a triple role: shielding properly speaking, ground continuity between at least the socket and the plug (and preferentially also with the printed circuit) and locking/unlocking of the plug in the socket.

In order to more completely illustrate these functions, we will consider FIG. 5, which illustrates a complete connector according to the invention, comprising a socket 1 (such as has just been described) and a plug 7.

This latter classically comprises a principal body 70, of insulating material, imprisoning a set of electrical contact elements 8, complementary to electrical contact elements 6, of equal number, and arranged in space in an appropriate manner, so that electrical coupling can be effected by introduction of the first into the second.

The set of electrical contact elements 8 is connected on the rear of plug 7 (in the example described) to a multistrand wire 71.

In one preferred variant of the invention, a shielding is provided on the outer walls, upper and lower, of plug 7: plates 9*a* and 9*b*, respectively.

The ground continuity between plug 7 and socket 1 is produced by the sliding friction of sliding contacts 52 on shielding 9*b*, on the one hand, and by the sliding friction of tabs 22 forming a spring on shielding 9*a*, more precisely of zone 26 constituting the base of the "V" (see FIG. 2*c*).

It is observed that this zone is very large since it covers practically the entire width of upper arm 12 (except for the narrow zones of hooks 24, whose role will be specified below, and the slots between tabs 22). The galvanic contact is therefore of good quality, inasmuch as sliding contacts 52 also contribute to this contact and, moreover, by spring effect, have a tendency to press principal body 70 towards the top (i.e., toward tabs 22).

The locking function, for its part, is produced simply by this spring effect. In fact, if shielding 9*a* is provided with openings 90*a* cooperating with hooks 24, when plug 7 is entirely inserted into socket 1, hooks 24 ratchet into these openings. This operation therefore locks plug 7 inside the socket and permits effective sliding friction of zones 26 of tabs 22 on shielding 9*a*. Auxilary openings 90*b* are provided on the opposite side of the shielding 9*a*.

For most application, the coupling of plug 7 onto socket 1 must be reversible. It is therefore necessary to be able to unlock plug 7 and extract it from socket 1.

To do this, in a preferred variant of the invention, a separate piece 3 of insulating material is provided. This piece has the general shape of projection having one or more slot(s) 32 into which the ends of projections 22 of plate 2 can be inserted (see FIG. 1). In order to be able to connect this separate piece 3 to plate 2, openings 31 are provided in the top wall 30 and extend into the bottom of the slot(s) 32, so that hooks 23, made on the ends of projections 22, ratchet into these openings. Thus a locking of separate piece 3 onto plate 2 is obtained.

Lower front end 33 of separate piece 3 is chamfered, bottom 34 being flat. When plug 7 is inserted, bottom 34 of the separate piece slides on the upper wall of body 70 of plug 7, or more precisely on shielding 9*a*. Hooks 24 are introduced into openings 90*a* bringing about the locking of the plug and the galvanic contact of zones 26, as described previously.

If one presses on the front of separate piece 3 (force $F_1$), due to above-mentioned chamfer 33, the latter rocks and hooks 24 are pulled out of their housings 90*a*. If this pressure is maintained and a pulling force (arrow $F_2$) is exerted, the plug can then be released from socket 1, chamfer 33 sliding on the upper wall of plug 7. These two operations (pressure and withdrawal) can be effected simply. It is sufficient to push with, for example, the thumb of one hand on the front of separate piece 3, forming a lever, and pull on plug 7 with the other hand.

Upon reading the preceding, it is easily observed that the invention clearly attains its objectives. It permits at the same time an efficacious shielding, a good ground continuity between the socket and the plug (and also, in a preferential variant, with the printed circuit), as well as a locking/unlocking of the plug in the socket. The unlocking is obtained simply by the addition of a separate piece.

In a subsidiary manner, the relative arrangement of sliding contacts 52 and projections 22 permits a good guiding of plug 7 during its introduction into socket 1.

These arrangements do not imply an appreciable increase in the complexity of the connector, nor of the manufacturing operations (when compared with a shielded connector). As has been shown in regard to FIG. 4, mounting is accomplished in a simple way. The additional component cost is insignificant. It essentially concerns the addition of a separate piece, made of inexpensive insulating material.

It must nevertheless be clear that the invention is not limited to only the examples of embodiment precisely described, notably in relation to FIGS. 1 to 6. Variations of shape and/or dimensions only constitute choices of a technological order, imposed by specific applications. In addition, the materials that can be used are the usual materials in the field.

Finally, other connector structures can be implemented, notably with regard to the socket. Although the information of the invention is particularly of interest for connectors whose socket is designed to be attached onto a printed circuit board, it should be clear that this condition is not indispensable.

What is claimed is:

1. A shielded connector comprising a socket (1) and a plug (7) designed to be coupled by insertion of the plug (7) into the socket (1), the plug being covered with a shielding (9*a*) of electrically conductive material on at least one of its walls, characterized in that at least one first wall of the socket (1), corresponding to that of the plug (7), is covered with a shielding (2,4) of electrically conductive material, in that this shielding (2,4) is extended toward a front end of the socket (1) by a strip made up of at least one projection (22) forming a spring projecting in front of a housing of the socket and being located in a path of an insertion of the plug into the socket so as to press on the shielding (9*a*) of the plug (7) during insertion of the latter and permit a galvanic contact between the shieldings of the plug (7) and the socket (1) wherein the shielding on the at least one first wall of the socket is ratcheted onto an outside of the at least one first wall of the socket (1) by first hooking means made up of terminal catches (21) encased in a groove (17) of the socket (1), and wherein the shielding on the at least one first wall of the socket is made up of a stack of two plates provided with second hooking means made up of complementary cut pieces (25,41), a first one of the plates comprising the terminal catches (21), and a second one of the plates carrying bent tabs at a forward end, the stack of two plates ratcheting onto the at least one first wall of the socket (1).

2. A shielded connector according to claim 1, further characterized in that the strip extending the shielding on a front of the socket (1) has several projections (22) separated by narrow slots, each projection forming a spring contacting the plug so that the strip contacts generally an entire width of the shielding (9*a*) of the plug (7).

3. A shielded connector according to claim 2, further characterized in that each projection forming a spring (22) is endowed with a "V"-shaped section, a base of the "V" rubbing on the shielding (9*a*) of the plug (7).

4. A shielded connector according to claim 1, further characterized in that at least one projection (22) is provided with first hooking means (24) and in that the shielding (9*a*) of the plug (7) has second hooking means (90*a*) complementary to the first hooking means (24) and cooperating with the latter, so as to lock the plug (7) in the socket (1), after complete insertion of the latter.

5. A shielded connector according to claim 4, further characterized in that the second hooking means comprises the shielding (9*a*) of the plug (7) being pierced to form openings therein, and the first hooking means are made up of hooks (24) ratcheting into these openings.

6. A shielded connector comprising a socket (1) and a plug (7) designed to be coupled by insertion of the plug (7) into the socket (1), the plug being covered with a shielding (9*a*) of electrically conductive material on at least one of its walls, characterized in that at least one first wall of the socket (1), corresponding to that of the plug (7), is covered with a shielding (2, 4) of electrically conductive material, in that this shielding (2, 4) is extended toward a front end of the socket (1) by a strip made up of at least one projection (22) forming a spring so as to press on the shielding (9*a*) of the plug (7) during insertion of the latter and permit a galvanic contact between the shieldings of the plug (7) and socket (1), wherein the shielding on the socket is made up of a stack of two plates provided with first hooking means made up of complementary cut pieces (25, 41), a first one of the plates comprising terminal catches (21), and a second one of the plates carrying bent tabs at a forward end, the stack of two plates ratcheting onto the at least one first wall of the socket (1).

7. A shielded connector according to claim 6, further characterized in that the shielding is ratcheted onto an outside of the at least one first wall of the socket (1) by second hooking means made up of the terminal catches (21) encased in a groove (17) of the socket (1).

* * * * *